US008991311B2

(12) United States Patent
Shpigel

(10) Patent No.: US 8,991,311 B2
(45) Date of Patent: Mar. 31, 2015

(54) HAND HELD ADHESIVE TAPE APPLICATOR

(76) Inventor: Leonid Shpigel, Cape Town (ZA)

( * ) Notice: Subject to any disclaimer, the term of this patent is extended or adjusted under 35 U.S.C. 154(b) by 160 days.

(21) Appl. No.: 13/060,343

(22) PCT Filed: Aug. 28, 2009

(86) PCT No.: PCT/ZA2009/000078

§ 371 (c)(1),
(2), (4) Date: Feb. 23, 2011

(87) PCT Pub. No.: WO2010/025479

PCT Pub. Date: Mar. 4, 2010

(65) Prior Publication Data

US 2011/0150554 A1 Jun. 23, 2011

(30) Foreign Application Priority Data

Sep. 1, 2008 (ZA) ..... 08/7478

(51) Int. Cl.
*B65H 35/07* (2006.01)
*B41F 17/13* (2009.01)
*B65H 35/00* (2006.01)

(52) U.S. Cl.
CPC ..... *B65H 35/0033* (2013.01); *B41F 17/13* (2013.01); *B65H 2301/5111* (2013.01)
USPC ..... 101/288; 101/213; 101/328; 156/386

(58) Field of Classification Search
CPC ..... B65H 35/0053; B41F 17/13
USPC ..... 101/328, 288, 213, 352.07, 352.08, 101/327; 156/DIG. 49, 385, 386
See application file for complete search history.

(56) References Cited

U.S. PATENT DOCUMENTS

| | | | | |
|---|---|---|---|---|
| 3,926,110 | A * | 12/1975 | Hubbard et al. | 101/92 |
| 4,068,028 | A * | 1/1978 | Samonides | 428/41.4 |
| 4,419,930 | A * | 12/1983 | Holland-Letz | 101/93.18 |
| 5,197,386 | A * | 3/1993 | Lin | 101/213 |
| 5,784,959 | A | 7/1998 | Larios | |
| 5,947,025 | A * | 9/1999 | Huang | 101/327 |
| 5,954,916 | A * | 9/1999 | Orlandi | 156/386 |
| 6,531,186 | B1 * | 3/2003 | Neuberger | 427/146 |
| 6,712,113 | B1 * | 3/2004 | Peggion | 156/577 |
| 2005/0019081 | A1 | 1/2005 | Baker et al. | |
| 2006/0280541 | A1 | 12/2006 | Lass | |

FOREIGN PATENT DOCUMENTS

| | | |
|---|---|---|
| WO | 2005/061356 A1 | 7/2005 |
| WO | 2009/026594 A2 | 2/2009 |

OTHER PUBLICATIONS

International Search Report, dated Jan. 5, 2010, from corresponding PCT application.

* cited by examiner

*Primary Examiner* — Daniel J Colilla
*Assistant Examiner* — Justin Olamit
(74) *Attorney, Agent, or Firm* — Young & Thompson

(57) ABSTRACT

A printing apparatus is provided that has a roller for dispensing adhesive tape and a printing wheel in association with an ink reservoir, the tape being presented with its adhesive surface presented to the printing wheel for the printing to be applied to the adhesive surface; and hence is reversed so that the adhesive surface with the printing can be applied to a substrate.

5 Claims, 5 Drawing Sheets

HAND HELD ADHESIVE TAPE APPLICATOR

TECHNICAL FIELD OF THE INVENTION

This invention relates to apparatus for printing on adhesive tape and, in particular to printing on the adhesive surface of the tape.

BACKGROUND ART

I have disclosed apparatus in my Patent Application WO 061356 for security sealing that includes means for adhering a printed strip between the tape and a substrate, such as a container, the printed strip being visible through a transparent zone in the tape—preferably in the centre thereof. Any tampering of the container will result in damage to the strip and this will be observable so that steps can be taken to investigate the tampering.

The apparatus involves a roller for applying the strip and it is an object of the present invention to dispense with the use of such a roller so that the cost of the apparatus is conveniently reduced and the printing process substantially simplified.

It is not desirable for direct printing to be applied to the top surface of the tape because of the poor adhesion of certain inks to plastic surfaces and the printing may be erased easily and there are difficulties involved in applying printing to the adhesive surface of the tape. It is an object of the present invention to provide apparatus that effectively applies printing to the adhesive surface of the tape.

U.S. Pat. No. 5,784,959 was the main citation in the PCT Application No. PCT/ZA2009/000078 from which the present application is derived. That patent describes a printer for printing on the adhesive side of a clear tape, the flow of ink being controlled by a compressor. The present invention aims to avoid the use of such ungainly apparatus.

DISCLOSURE OF THE INVENTION

According to the present invention apparatus is provided that includes a printing wheel or the like with ink feeding means, the wheel being located for applying printing to the underside of an adhesive tape prior to the application of the tape to a substrate.

Thus, the printing wheel is presented with the adhesive side of the tape as it is wound out from a roller and the tape is then reversed in direction so that the adhesive surface is presented to the substrate. The presentation of the adhesive surface of the tape to the printing wheel may be effected by means of a roller which also serves to reverse the direction of the tape after printing. In other words, the non-adhesive surface passes over the reversing roller and the adhesive surface is available to be applied to the substrate.

In a preferred form of the invention an intermediate roller is provided to guide and/or locate and/or tension the adhesive surface correctly in relation to the printing wheel.

The adhesive surface should not adhere to the intermediate roller. Thus, it may be coated with a non-sticking composition such as a silicone and/or the surface may be knurled, corrugated or otherwise reduced in area contact with the adhesive surface.

The means for feeding ink may comprise an absorbent roller in communication with an ink reservoir. This means may be removable for re-inking or changing the means; and may be adjustable in the frame to provide the correct pressure on the printing wheel.

The printing wheel may be replaceable by other wheels having different printing content or width or other necessary difference.

The printing wheel may be made from any suitable material that is capable of receiving ink and transferring it to the surface of the tape without smudging.

It will be appreciated that the printing wheel may be adapted to achieve multicoloured printing. Alternatively a plurality of printing rollers may be provided for the same purpose. A plurality of ink rollers and reservoirs may be provided for either of these purposes.

Printing changes may be effected by merely changing a peripheral printing strip for the wheel.

The apparatus may also include a roller or wheel that is adapted to form perforations across the tape as described in my South African Patent Application 2007/06992.

BRIEF DESCRIPTION OF THE DRAWINGS

An embodiment of the invention is described below with reference to the accompanying drawings, in which.

DETAILED DESCRIPTION OF THE PREFERRED EMBODIMENT

Figure 1:
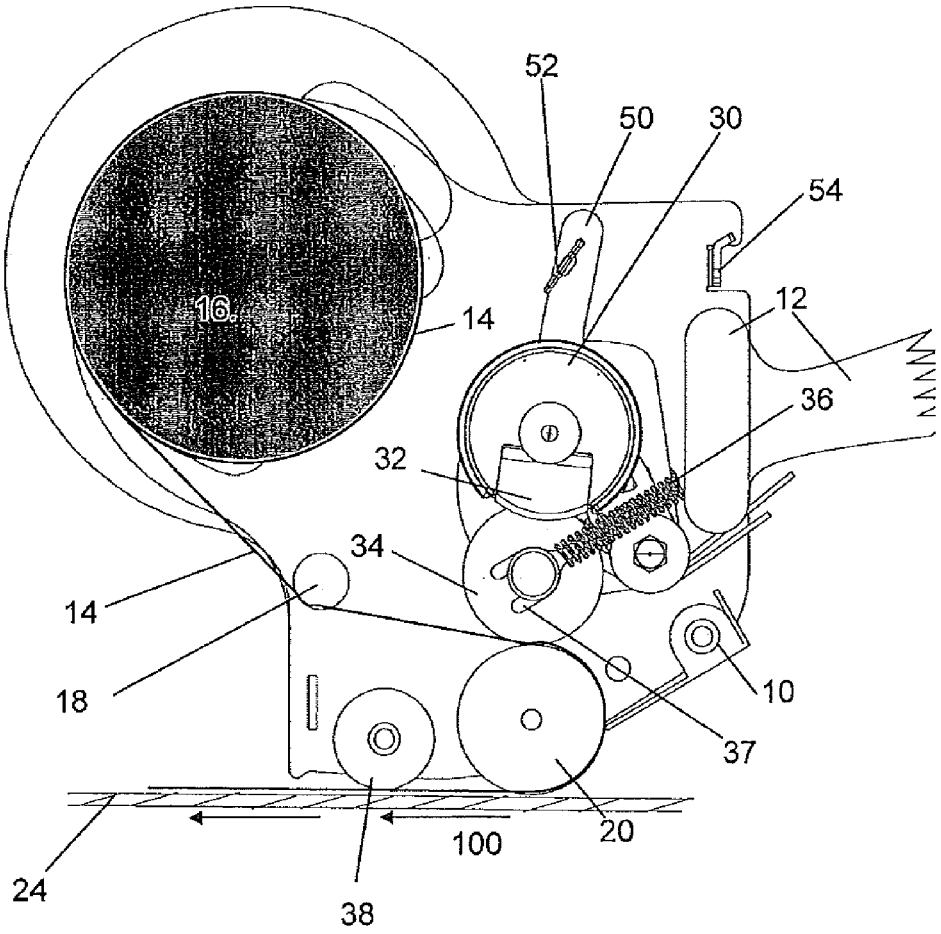
FIG. 1 is a side view with the near side plate removed for illustrative purposes.

The hand held tape applicator illustrated comprises a frame 10 carries a handle 12 by means of which a desired pressure may be applied to the adhesive tape 14 via the pressure roller 20 when applying the tape to a particular substrate. The tape 14 is carried on a roller 16 and passes over a roller 18 with the adhesive surface of the tape 14 in contact with the roller 18. This roller 18 provides tensioning of the tape 14 as well as serving as a guide. In order to avoid undue adhesion of the tape 14 to the surface of the roller 18, the surface may be coated with a non-stick composition such as a silicone and/or the roller 18 is knurled or corrugated to reduce the contact area and, therefore, the degree of adhesion.

The tape then passes over roller 20 where a printing operation is achieved on the adhesive face of the tape (see below) and then reverses to exit the device in the direction of the arrow 100. Pressure is applied to the tape by means of the handle 12 so that the tape is adhesively applied to a substrate 24.

Turning to FIG. 1, an inking and printing station is provided in the form of a reservoir 30 which has a window 32 for transferring ink from an inking pad to a printing roller 34 which carries chosen printed information on its peripheral surface. The printing roller 34 is supported by a compression balancing spring 36 with a forked member 37 engaging the axle thereof. When it is required to disengage the printing roller, for example during replacement of the reservoir or inking pad, the spring 36 is merely pulled back against the compression for the fork to be disengaged from the axle.

The tape is finally perforated so that any tampering or temporary removal of the tape is immediately observable, the perforations being applied by means of spiked roller 38.

Figure 2:
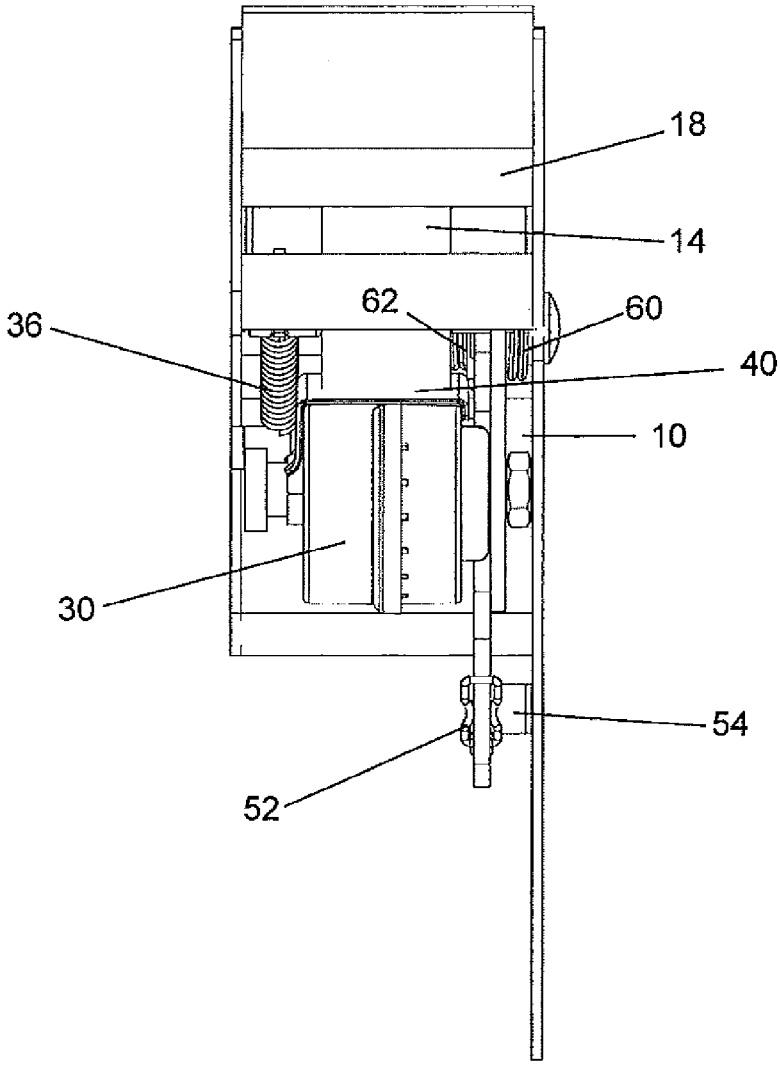
FIG. 2 is a top view.
Figure 3:
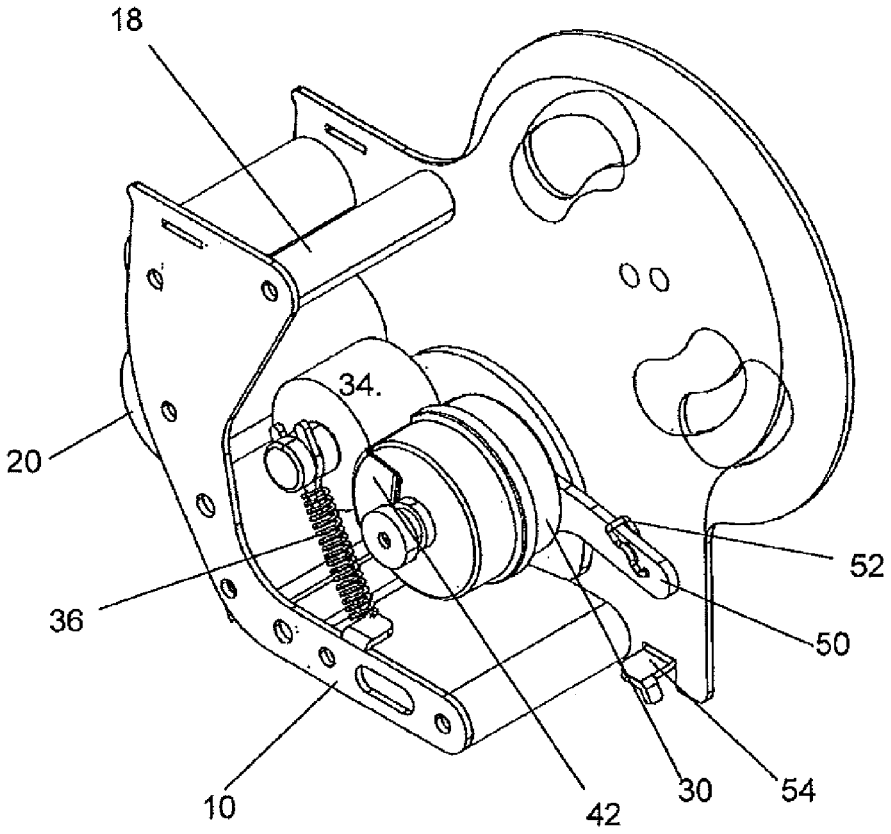
FIG. 3 is a rear view.
Figure 4:
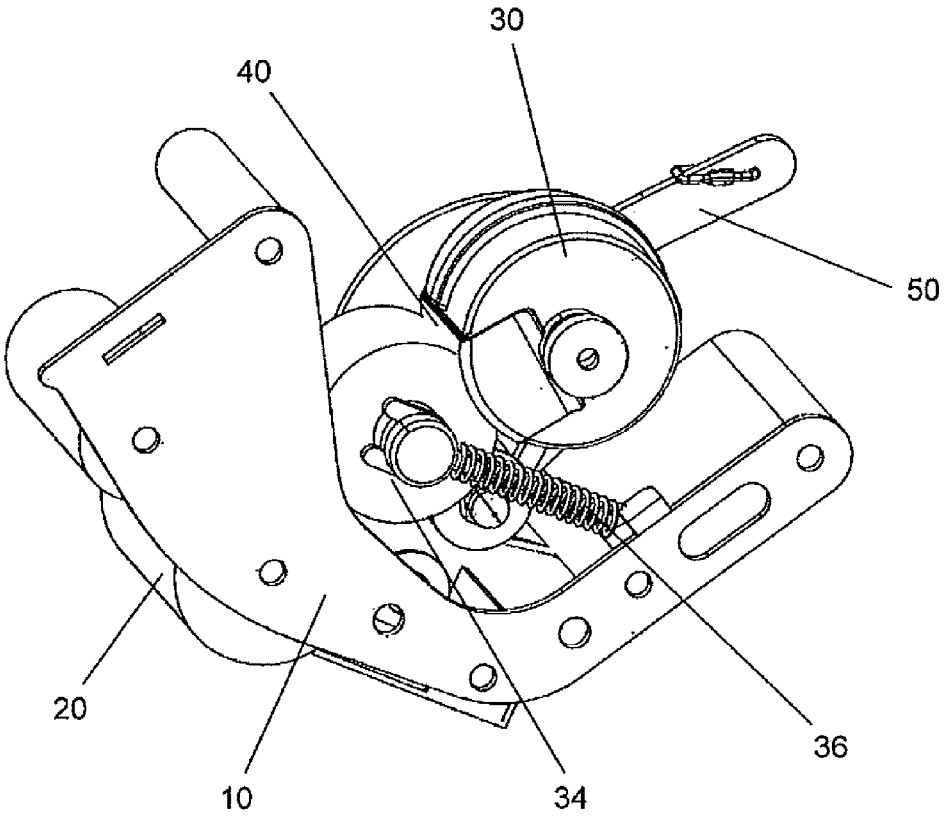
FIG. 4 is an angled front view.
Figure 5:
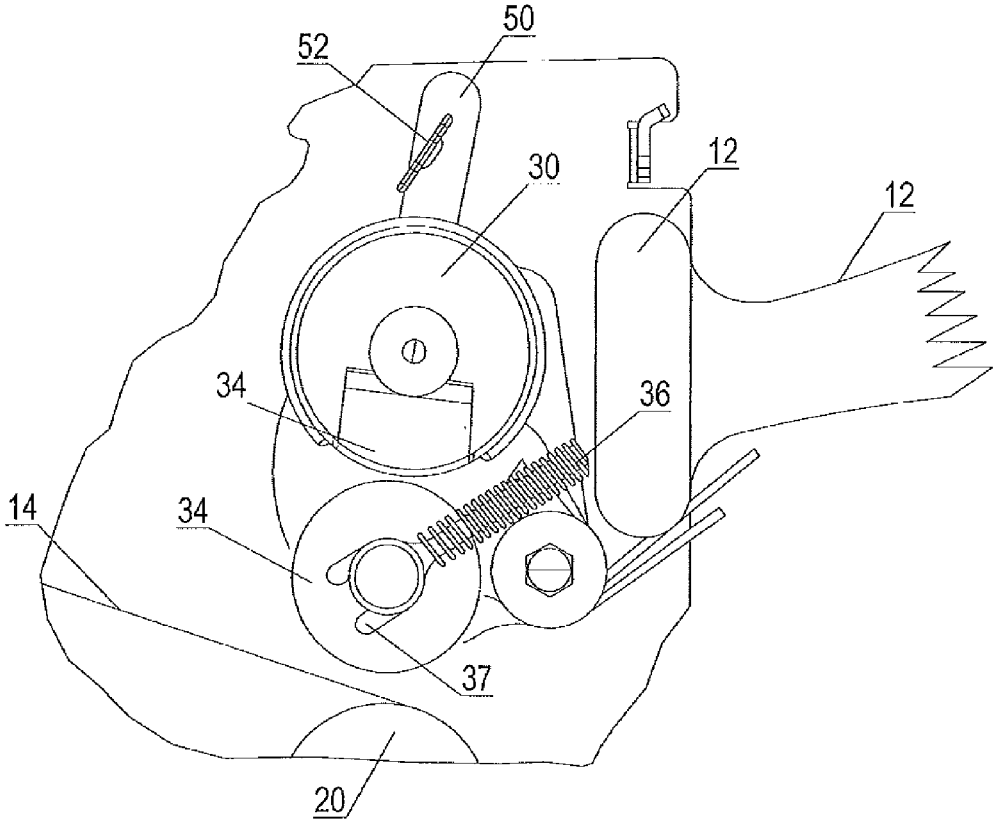
FIG. 5 shows the printing roller separated from the pressure roller.

In FIG. 2, the ink reservoir is shown with an inking pad 40 that transfers the ink from the reservoir to the printing roller 34.

The reservoir carries an ink cartridge that has an ink roller. The reservoir includes a window which has a cover 42 which is discarded before use. When the ink has been used up the cartridge is replaced with a new one, the cover of the new cartridge being discarded before use.

Above the pressure roller 20 is an inking arrangement including the printing wheel 34 that is in contact with an inking pad 40 of an ink reservoir 30.

As the tape is drawn from the roller 16 and over the roller 18 it comes into contact with the printing wheel that has printed information on its peripheral surface, the degree of contact being predetermined to achieve the best results in so far as printing quality is concerned.

As the frame is drawn from left to right, the adhesive tape is drawn past the printing wheel, over the reversing pressure roller 20 and then applied with its adhesive surface downwards on to a substrate such as a box or other container.

A release lever 50 is provided to release the printing wheel from the tape and also separates the inking pad from the printing wheel. This enables the device to be used in circumstances where printing is not required. The lever has a clip 52 that may engage with formation 54 so that it can be held in the non-printing mode.

A spring 60 serves to adjust the pressure of the inking pad against the printing wheel, while spring 62 applies pressure between the printing wheel and the tape.

The apparatus may also include a roller or wheel 38 that is adapted to form perforations across the tape as described in my South African Patent Application 2007/06992.

The invention claimed is:

1. A hand-held adhesive tape applicator, comprising:

a frame;

a handle carried by the frame;

a roller rotatably mounted on the frame and configured to carry a reel of adhesive tape;

a printing roller carrying characters that are to be printed onto the adhesive tape;

a pressure roller configured to press the adhesive tape against a surface of a substrate, tape guides for guiding the adhesive tape;

an ink pad for applying ink to said characters; and a mounting structure for said printing roller wherein the printing roller is displaced between a first position in which the printing roller is in contact with the adhesive tape and a second position in which the printing roller is separated from the adhesive tape, wherein the mounting structure is such that the first position is a printing position in which the printing roller contacts the ink pad and the adhesive tape, and the second position is a non-printing position in which the printing roller is separated from both the ink pad and the tape.

2. A hand held adhesive tape applicator as claimed in claim 1, wherein the mounting structure includes a first spring for pressing the printing roller against the adhesive tape.

3. A hand held dispenser as claimed in claim 2, further comprising a second spring for pressing the ink pad against the printing roller.

4. A hand held dispenser as claimed in claim 2, wherein the tape guides comprise guide rollers mounted to guide the adhesive tape toward the printing roller and the pressure roller.

5. A hand held adhesive tape applicator as claimed in claim 1, wherein the mounting structure includes i) a release lever that releases the printing roller from the adhesive tape and also separates the inking pad from the printing roller, and ii) a clip that engages with a formation attached to the frame to hold the lever and the printing roller in the non-printing position.

* * * * *